US007891034B2

(12) United States Patent
Smith

(10) Patent No.: US 7,891,034 B2
(45) Date of Patent: Feb. 22, 2011

(54) DOOR MOUNTED CHANGE TABLE

(75) Inventor: Tyson Kirk Smith, Lethbridge (CA)

(73) Assignee: Tyson Smith, Lethbridge, AB (CA)

( * ) Notice: Subject to any disclaimer, the term of this patent is extended or adjusted under 35 U.S.C. 154(b) by 0 days.

(21) Appl. No.: 12/592,584

(22) Filed: Nov. 30, 2009

(65) Prior Publication Data

US 2010/0138995 A1 Jun. 10, 2010

Related U.S. Application Data

(60) Provisional application No. 61/120,054, filed on Dec. 4, 2008.

(51) Int. Cl.
*A47D 5/00* (2006.01)

(52) U.S. Cl. ..... 5/655; 5/947

(58) Field of Classification Search ..... 5/655, 5/947, 93.1, 94, 99.1, 118
See application file for complete search history.

(56) References Cited

U.S. PATENT DOCUMENTS 3,078,478 A * 2/1963 Sheahan ..... 5/93.1
3,269,621 A * 8/1966 Dishart ..... 224/585
3,644,947 A * 2/1972 Padera ..... 5/100
3,659,297 A * 5/1972 Schutz ..... 5/655
3,746,390 A * 7/1973 Koah ..... 297/188.08
4,123,809 A * 11/1978 Pugh ..... 4/659
4,133,063 A * 1/1979 Jones-Steele ..... 5/99.1
4,190,918 A * 3/1980 Harvell ..... 5/653
4,319,367 A * 3/1982 Cantillo ..... 4/353
4,466,146 A * 8/1984 Regan ..... 5/98.3
4,935,973 A * 6/1990 Behrman ..... 5/2.1
5,299,336 A * 4/1994 Marteeny ..... 5/655
5,310,242 A * 5/1994 Golder ..... 297/14
6,125,487 A * 10/2000 Ive ..... 5/655
6,272,704 B1 * 8/2001 Cutler ..... 5/655
6,389,624 B1 * 5/2002 Madole ..... 5/655
6,421,856 B1 * 7/2002 Furnback ..... 5/655
2010/0138995 A1 * 6/2010 Smith ..... 5/424

* cited by examiner

*Primary Examiner*—Robert G Santos
(74) *Attorney, Agent, or Firm*—Usha Koshy

(57) ABSTRACT

A door mountable infant change table comprising a base structure and a changing area platform structure hingedly attached to each other and capable of vertical mounting on the surface of a door or similar structure through the use of straps secured by brackets to the top and bottom rims of a door or other structure that allow for sliding the change table and securing it to a height suited to the person changing the infant at the change table by means of clips provided near the holes of the change table through which the straps are threaded.

7 Claims, 4 Drawing Sheets

DOOR MOUNTED CHANGE TABLE

FIELD OF THE INVENTION

The present invention generally relates to infant changing tables. More particularly, the invention relates to infant changing tables that are attached to another structure such as a door or a wall.

BACKGROUND OF THE INVENTION

Infant diaper changing practices and structures have progressed from the use of a bed to changing tables of the kind contrived by mounting a soft pad over a dresser or other stationary furniture for use at home. There are many households where either there are not enough rooms to set up a separate baby nursery or limited space to set up a separate changing station such as the use of a dresser or other furniture to change the infant's diapers. In those circumstances, it is common practice to use a bed, the floor, carpet, or even the dinner table to change the infant's soiled diapers, compromising hygiene. Thus there is a need in the art for a hygienic and space saving structure specifically dedicated to the infant's diaper changing needs in households with limited space. The present invention provides a space saving changing table that can be installed on either side of a room door to meet the diaper changing needs of a baby and conveniently folded up on its base to lie against the door surface and away from traffic between rooms when not in use.

The need for a means to change infant's diapers when away from home has produced several innovative concepts in portable diaper changing structures such as pads and tables described in U.S. Pat. No. 7,520,010, U.S. Pat. No. 7,350,252, and U.S. Pat. No. 6,889,397; and portable changing tables of the kind disclosed in U.S. Pat. No. 6,421,856 and U.S. Pat. No. 6,389,624. These pads and tables are quite often bulky and take up space in a vehicle in addition to other baby changing and feeding luggage such as diaper bags and accessories, strollers etc., when traveling with a baby to visit family and friends. The present invention provides a space saving changing table that can be stored by family and friends at their residences and easily set up to provide a changing table for a visiting baby.

The critical need for diaper changing tables in public restrooms has seen the advent of wall mounted baby changing tables in those facilities. U.S. Pat. No. 4,216,951, one such earlier granted patent discloses a baby-changing apparatus adapted to be foldably mounted to a vertical support, such as walls and partitions in public restrooms, restaurants, department stores, airports, and the like. U.S. Pat. No. 4,965,896 describes a fold up table extending from a room wall and constructed of a hollow rectangular tray capable of supporting a baby while the baby's diaper is being changed. A countertop mountable infant changing station is described in U.S. Pat. No. 5,987,677. A series of patents granted to Helmsderfer, the most recent one described in U.S. Pat. No. 7,426,765 comprises a diaper changing station for mounting on a wall surface.

The infant diaper changing tables described and patented thus far have been configured for wall mounting which involves drilling holes in walls in order to mount these structures. Dismantling and moving these changing tables to another location on the wall or to another room wall would be cumbersome and leave holes in the walls requiring patching up, painting etc. Thus there is a need in the art for a space saving infant changing table that can be conveniently mounted, with minimal damage to the mounting surface and removed for storage when not in use. The present invention fulfills that need by providing a changing table that can be mounted on a door surface by means of a strap or bracket and capable of being positioned to the height of the user by sliding the changing table vertically through the length of the door on the straps.

The present invention fulfills the deficiencies in the prior art for a portable space saving infant changing table for use at home, or when visiting family and friends; for use by baby sitters and grandparents in their own homes; for use in day care facilities, or in public restrooms when traveling with a baby.

SUMMARY OF THE INVENTION

The present invention relates to a portable, door mounted infant changing table for use at any residence whether the baby's own home or that of family and friends where space is limited. The changing table of the present invention provides a hygienic area for changing an infant's soiled diapers without the use of other furniture such as beds, tables, or floors in the house. Another advantage of the portable nature of the changing table of the present invention is that it can be easily mounted on the door or ledge of a public or hotel restroom to change the baby's diapers while traveling.

In an exemplary embodiment of the present invention, the changing table is comprised of a base structure capable of being mounted on either side of a door surface by means of two parallel adjustable straps attached to the top and bottom of the door rims by means of brackets or the like and are passed through evenly spaced holes provided on the top and bottom of the base structure, to position the base structure securely over the door surface by means of clips provided near the holes of the base structure. These straps are then tightened to secure the change table against the door.

In this embodiment of the present invention, the functional, infant changing area platform structure of the change table is hingedly attached to the base structure mounted over the door by means of the two straps. In this embodiment, the changing area structure is additionally provided with a set of straps to secure the infant in place while changing diapers.

In a preferred embodiment of the present invention, the infant change table is provided with a diaper/wash cloth holder positioned at the center of the base structure above the changing area structure and a disposable changing pad laid flat on the changing area structure surface.

These and other features and advantages of the present invention will become obvious to one skilled in the art through the description of the drawings, detailed description of the invention and the appended claims.

DETAILED DESCRIPTION OF THE INVENTION

The present invention fulfills the need in the prior art for a mounted infant changing table that is not permanently attached to a wall or other structure. The portable nature of the present invention and the convenience of mounting over the surface of a door with ease by means of sturdy straps provides a changing table that is both aesthetically pleasing and safe to use for changing the diaper or clothes of an infant especially in environments with limited space.

Figure 1:
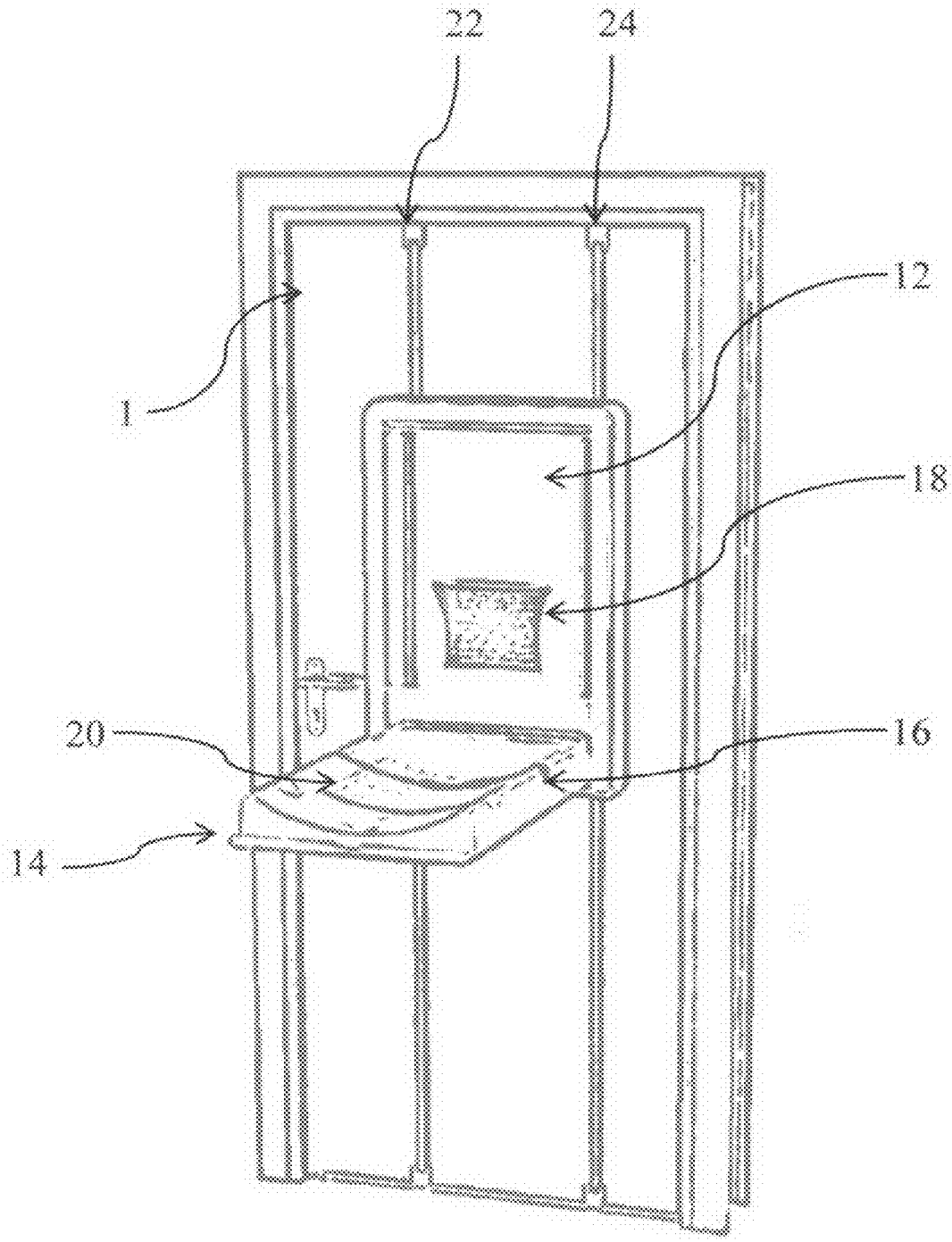
FIG. 1 shows a perspective view of the change table mounted on the door.

Referring now to FIG. 1, is shown an open perspective view of the change table with the base structure 12 mounted on the door 1 surface by means of two straps, 22 and 24 that run parallel and span the length of door 1 and are attached to door 1 by means of brackets at the top and bottom rims of the door 1. In this embodiment of the invention, the straps holding the base structure 12 are passed through two holes at the top and two holes at the bottom of the base structure 12 to hold the structure flush and securely against the surface of door 1. In the preferred and exemplary embodiment of the present invention, the base structure of the change table can be slidably moved up and down the length of the door to a height suitable for the person changing the infant's diaper's or clothes. The change table will be held securely in place after adjusting to the desired height on the straps attached to the door, by means of specifically constructed clips located near the holes used to thread the change table through the straps.

Referring again to FIG. 1, the changing area platform structure 14 is shown attached to and protruding from the base structure 12 and provides a platform to lay the infant down to change diapers and other clothing. There is provided a set of straps 16 to secure the infant while changing and a disposable pad 20 to place beneath the infant while changing diapers, facilitating hygiene. About the center of the base structure 12 and above the lower changing area platform structure 14 is provided a receptacle 18 to hold diapers, washcloths, wipes etc. for the infant's changing needs.

Figure 2:
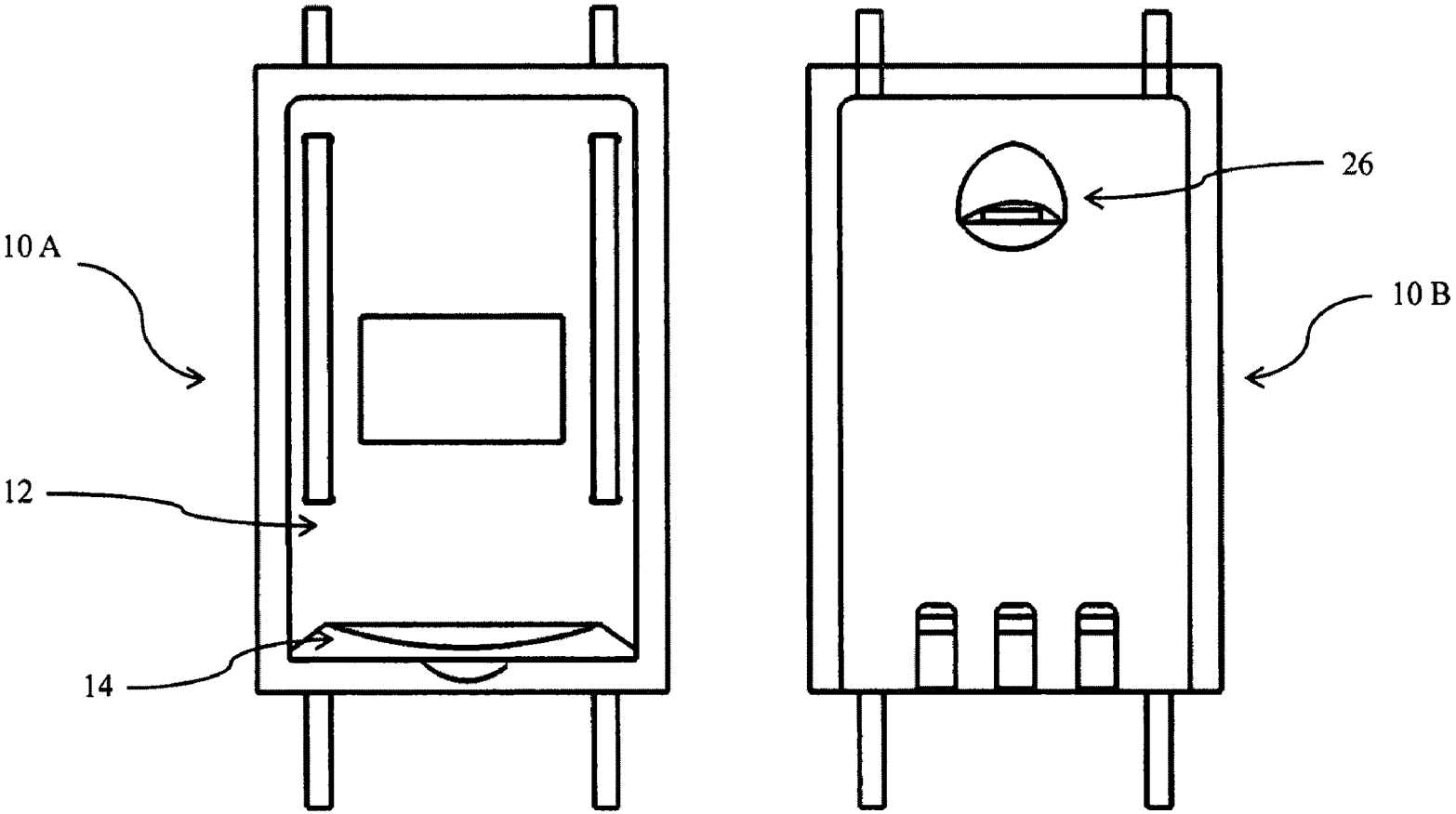
FIG. 2 shows the open and closed views of the change table

FIG. 2 shows perspective views of the change table in the open 10 A and closed 10 B positions. The base structure 12 and the changing area platform structure 14 attached to the base structure 12 are shown in this open view of the change table. Referring again to FIG. 2, 10 B shows the closed view of the change table with the lower changing area platform structure 14 folded up to meet the top portion of the base structure 12 and locked in place by the locking devise 26.

Figure 3:
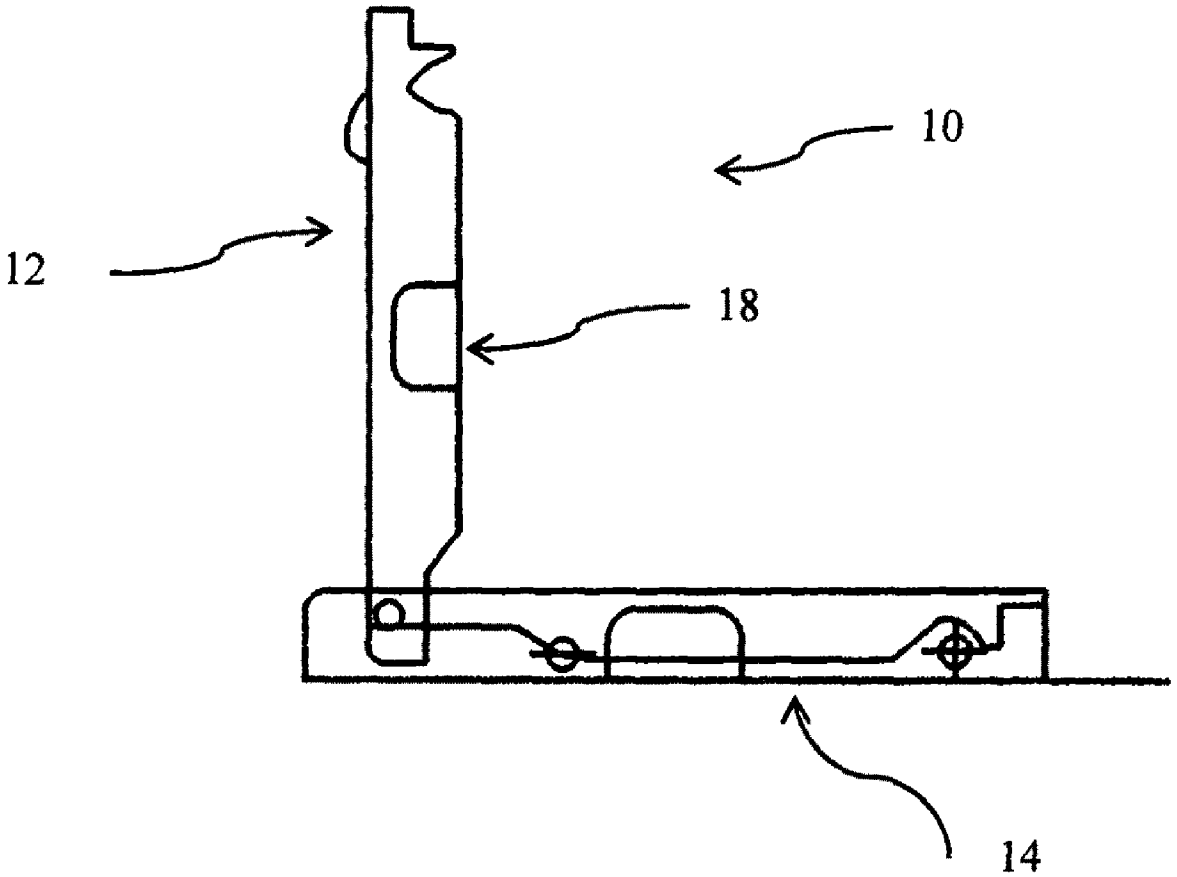
FIG. 3 shows a cross sectional side view of the change table.

FIG. 3 is a side cross sectional view of the change table 10 with the base structure 12 in the open vertical position and the changing area platform structure 14 in the horizontal position, hingedly attached to the base structure of the change table base 12.

Figure 4:
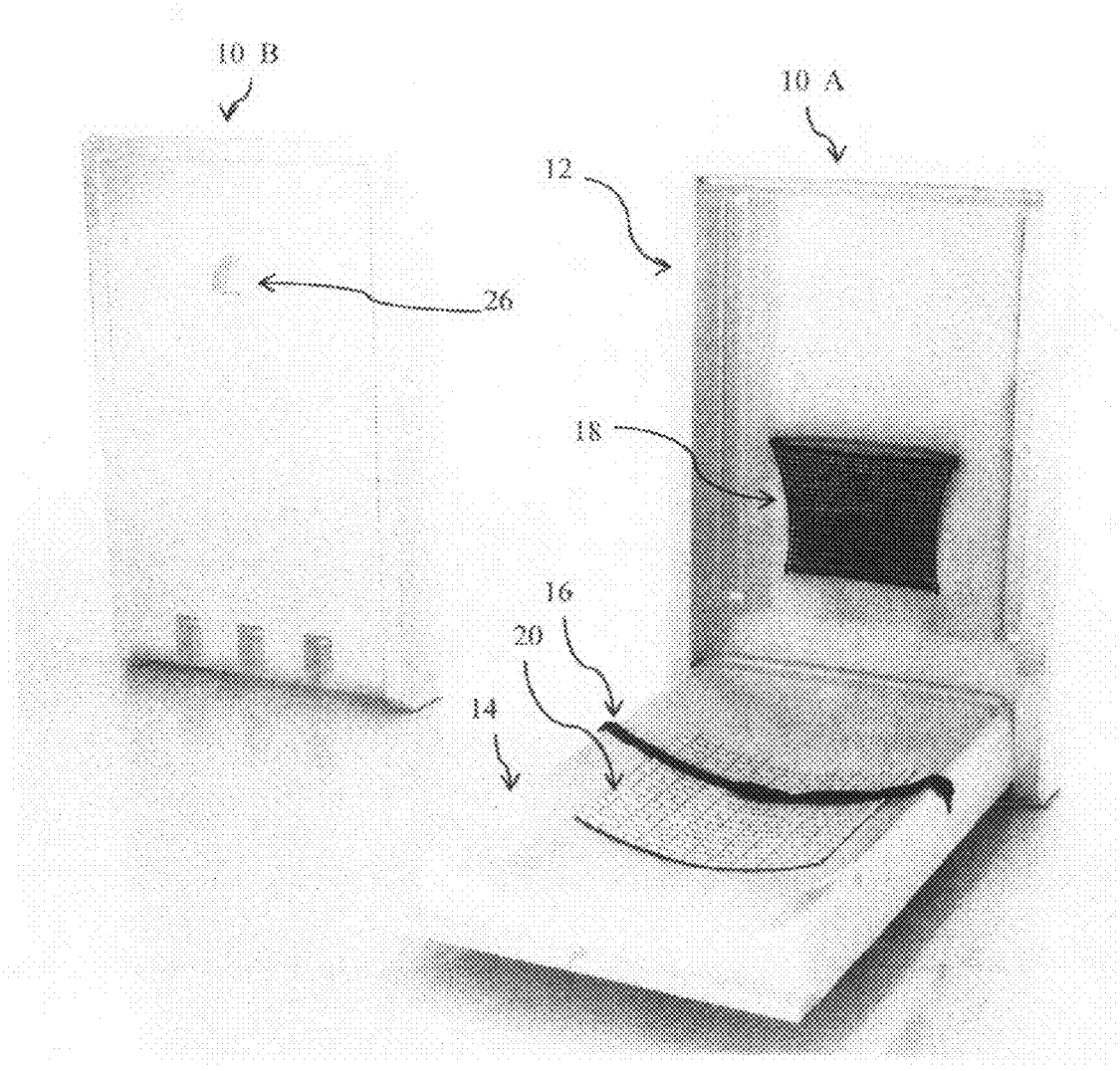
FIG. 4 shows a perspective view of the change table in the open and closed positions.

FIG. 4 is a perspective view of the change table in an open, 10A and closed, 10B positions. The base structure 12 and the changing area platform structure 14 are molded from plastic or other such suitable material. The set of straps 16, the disposable pad 20, and the receptacle 18 for holding diapers, wash cloths, wipes etc. within easy reach of the caregiver can be seen in this view of an exemplary embodiment of this invention. The device 26 for opening and closing the changing area platform structure 14 can be seen clearly in the closed view 10B of this Figure.

In a preferred embodiment of the present invention, the change table 10 is constructed of sturdy light weight plastic material that can with stand the weight of an infant in diapers. The diaper and wash cloth receptacle 18 is preferably constructed of mesh or other like material.

In another embodiment of the present invention, the change table 10 is fastened to the door 1 surface by means of brackets that run up and down or side to side on the door.

The portable nature of the infant change table of the present invention, provides for its use in public restrooms by mounting over doors or other wall ledges in these facilities.

The foregoing description of the invention through the figures along with the preferred embodiments should not be construed to limit the scope of the invention. It should be understood and obvious to one skilled in the art that the embodiments of the invention thus described may be further modified without departing from the spirit and scope of the invention as set forth in the claims that follow.

What is claimed is:

1. A door mounted infant change table comprising:

a base structure member configured to mount vertically to a door surface;

a changing area platform structure member hingedly connected to the base structure member;

said changing area platform structure member operable in an open position perpendicular to the base structure member to receive an infant in a supine position;

said changing area platform structure member snuggedly fitting to the base structure member in a closed position when not in use; and a set of substantially vertical and parallel strap members inserted through symmetrically spaced holes in the base structure member and attached to top and bottom rims of a door structure member by means of brackets secured to upper and lower ends of the strap members.

2. A door mounted infant change table of claim 1 wherein the base structure member is operable slidably on the strap members to any height and position on the door structure member for the convenience of a caregiver while changing the infant's diapers and clothes.

3. A door mounted infant change table of claim 1 wherein the base structure member provides a receptacle to hold diapers, wash cloths, and other accessories at a convenient height and reach in the inner center space of the base structure member.

4. A door mounted infant change table of claim 1 wherein the changing area platform structure member provides a set of straps to hold the infant securely while changing diapers or clothes.

5. A door mounted infant change table of claim 1 wherein the changing area platform structure member is provided with a disposable sanitary pad.

6. A door mounted infant change table of claim 1 wherein, the change table is portable.

7. A door mounted infant change table of claim 1 wherein the base and platform structure members are molded from sturdy plastic or similar material.

* * * * *